US006196558B1

(12) United States Patent
Simon

(10) Patent No.: US 6,196,558 B1
(45) Date of Patent: Mar. 6, 2001

(54) APPARATUS FOR PRACTICING AERIAL SNOWBOARD MANEUVERS

(76) Inventor: Basil W. Simon, 2340 Kalorama Rd. NW., Washington, DC (US) 20008

( * ) Notice: Subject to any disclaimer, the term of this patent is extended or adjusted under 35 U.S.C. 154(b) by 0 days.

(21) Appl. No.: 09/256,117

(22) Filed: Feb. 24, 1999

(51) Int. Cl.[7] ..... A63C 5/00

(52) U.S. Cl. ..... 280/14.2; 280/11.3; 482/15; 482/27

(58) Field of Search ..... 280/14.2, 87.042, 280/809, 11.3; 482/15, 23, 27, 77

(56) References Cited

U.S. PATENT DOCUMENTS

| | | | | |
|---|---|---|---|---|
| 829,050 | | 8/1906 | Anderson . | |
| 834,526 | * | 10/1906 | Jones | 280/11.3 |
| 2,685,141 | * | 8/1954 | Davenport | 36/7.6 |
| 2,929,636 | * | 3/1960 | Jones et al. | 280/11.13 |
| 2,946,599 | * | 7/1960 | Hunsbedt | 180/11.13 |
| 4,004,355 | * | 1/1977 | Koblick | 36/122 |
| 4,108,452 | | 8/1978 | Baron | 280/11.3 |
| 4,180,260 | | 12/1979 | Slagle | 272/97 |
| 4,225,131 | * | 9/1980 | Sidlinger et al. | 272/109 |
| 4,379,564 | * | 4/1983 | Welker | 280/11.2 |
| 4,403,785 | | 9/1983 | Hottel | 280/12 H |
| 4,468,045 | * | 8/1984 | Sarazen | 280/11.3 |
| 4,824,101 | * | 4/1989 | Karlas | 272/66 |
| 4,846,744 | | 7/1989 | Love | 441/75 |
| 4,969,655 | * | 11/1990 | Katz | 280/14.2 |
| 4,974,868 | * | 12/1990 | Morris | 280/609 |
| 5,014,450 | * | 5/1991 | McGrath | 36/124 |
| 5,080,382 | * | 1/1992 | Franz | 280/87.042 |
| 5,167,553 | | 12/1992 | Wilson | 441/75 |
| 5,312,258 | | 5/1994 | Giorgio | 434/253 |
| 5,368,536 | | 11/1994 | Stodgell | 482/79 |
| 5,591,060 | | 1/1997 | Forsyth | 441/75 |
| 5,649,722 | * | 7/1997 | Champlin | 280/818 |
| 5,966,844 | * | 10/1999 | Hellerman et al. | 36/122 |

OTHER PUBLICATIONS

Wave Rave Advertisement, Transworld Snowboarding Magazine, Mar. 1999.*

* cited by examiner

*Primary Examiner*—J. J. Swann
*Assistant Examiner*—J. Allen Shriver
(74) *Attorney, Agent, or Firm*—Dergosits & Noah LLP

(57) ABSTRACT

An apparatus for practicing aerial snowboard maneuvers is described. A wooden footboard is formed in an elongated oval shape that matches or approximates the shape and size of a standard snowboard. One or more sets of strap holes are cut into the footboard to accommodate the insertion of flexible straps for each foot. Flexible straps are threaded through the strap holes for each foot and secured over the user's shoes. Different sets of strap holes for each foot allow a user to change his stance on the footboard. The board is used in conjunction with a trampoline or similar bouncing device By jumping up and down on the trampoline while wearing the board, the user is able to practice aerial snowboard maneuvers.

22 Claims, 7 Drawing Sheets

APPARATUS FOR PRACTICING AERIAL SNOWBOARD MANEUVERS

FIELD OF THE INVENTION

The present invention relates generally to snowboard equipment, and more specifically to an apparatus for practicing aerial snowboard maneuvers.

BACKGROUND OF THE INVENTION

Within recent years, snowboarding has become a popular snow activity. The design and mechanics of a snowboard allow a snowboarder to engage in a number of different aerial tricks and maneuvers beyond the simple jumps performed by traditional skiers. On suitable terrain, an accomplished snowboarder can perform a wide variety of aerial flips and twirls. Because snowboarding is essentially a seasonal activity, participation and training is limited to periods in which there is sufficient snow and favorable weather conditions to allow the activity. Moreover, the use of snowboards in certain ski resorts or areas may be restricted to certain limited courses reserved only for snowboard use. As a result, snowboarding may become an increasingly limited and expensive sport in which to participate. Because of this, the opportunity for a snowboarder to learn and practice and aerial maneuvers and tricks may be significantly limited. It is therefore desirable to provide a snowboard training system that allows a snowboarder to practice snowboarding at any time of the year and on surfaces other than snow.

To get involved in snowboarding, a person is typically required to purchase complicated and expensive equipment, such as snowboards, special shoes, and binding systems. Such equipment is often overly expensive and complex for people desiring to simply learn the mechanics of snowboarding or to practice certain techniques, such as aerial maneuvers. It is therefore desirable to provide a snowboard training system that is simple and inexpensive enough to allow broad participation. It is further desirable to provide a snowboard practice system that allows a user to exclusively practice aerial snowboard tricks without requiring a snow-covered surface

SUMMARY AND OBJECTS OF THE INVENTION

An apparatus for providing practice of snowboard aerial maneuvers is described.

It is an object of embodiments of the invention to provide a system of practicing snowboarding techniques that may be used on dry land or in adverse weather conditions.

It is a further object of embodiments of the invention to provide a snowboard practice device that provides a simple and inexpensive simulation of a conventional snowboard and snowboard binding system.

It is yet a further object of embodiments of the invention to provide a snowboard binding system that may be adapted for use on a practice snowboard.

In one embodiment of the present invention, a wooden footboard is cut in an elongated oval shape that matches or approximates the shape and size of a standard snowboard or skateboard. Multiple sets of holes are cut into the footboard to accommodate the insertion of flexible straps. Straps threaded through the holes are used to securely attach the footboard to the user's feet. Two or more different sets of strap holes are provided for each foot to allow the user to change foot position or stance on the footboard. The footboard with the straps installed comprises a practice snowboard that is used in conjunction with a trampoline or similar bouncing device. By jumping up and down on the trampoline while wearing the practice snowboard, the user is able to practice aerial snowboard maneuvers.

Other features and advantages of the present invention will be apparent from the accompanying drawings and from the detailed description that follows.

BRIEF DESCRIPTION OF THE DRAWINGS

The present invention is illustrated by way of example and not limitation in the figures of the accompanying drawings, in which like references indicate similar elements, and in which.

DETAILED DESCRIPTION

An apparatus for practicing aerial snowboard maneuvers is described. In one embodiment of the present invention, a footboard is formed in the shape of a conventional snowboard or skateboard. Two or more sets of holes are cut into the footboard to accommodate the insertion of flexible straps that are used to secure the user's feet to the footboard. The footboard with straps or similar bindings installed comprises a practice snowboard that is used in conjunction with a trampoline or similar bouncing device. By jumping up and down on the trampoline while wearing the practice snowboard, the user is able to practice aerial snowboard maneuvers.

Figure 1A:
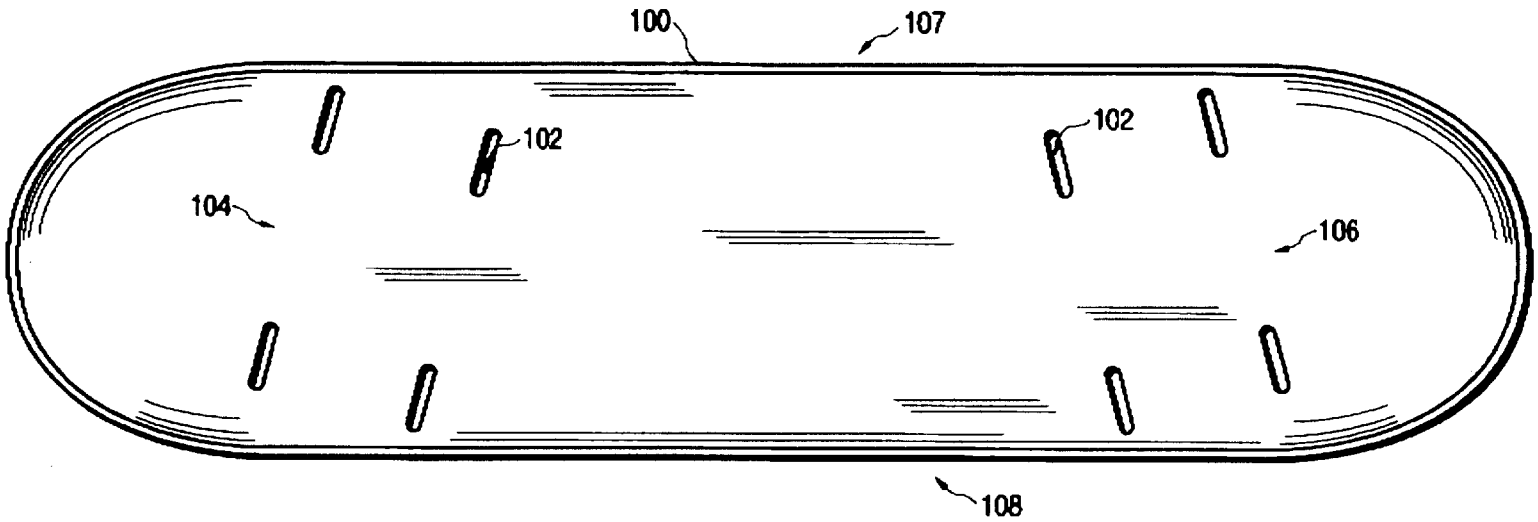
FIG. 1A illustrates a top view of a practice snowboard for use with a snowboard practice system, according to one embodiment of the present invention.

FIG. 1 A illustrates a practice snowboard according to one embodiment of the present invention. The practice snowboard comprises a footboard 100 that is cut and formed into an elongated oval shape that matches or approximates the size and shape of a standard snowboard or skateboard. For the embodiment illustrated in FIG. 1A, footboard 100 includes two sets of strap holes 104 and 106. The holes 102 within each set of strap holes is designed to accommodate a strap or set of straps that are used to strap down the shoes of a person using the practice snowboard.

For the embodiment illustrated in FIG. 1A, each of the holes is an elongated oval hole that can accommodate a flat fabric or leather strap approximately one inch to two and a half inches wide. In one embodiment of the present invention, four strap holes are provided for each shoe. The distance between the first set of strap holes 104 and the second set of strap holes 106 is approximately two feet. This distance corresponds to the distance between shoe binding points on a standard snowboard, and can be altered in alternative embodiments of the present invention to accommodate users of different heights. The orientation of one or both sets of strap holes 104 and 106 is angled relative to a longitudinal axis of the footboard as defined by the heel side 107 and the toe side 108 of footboard 100. In one embodiment of the present invention, the angle of the strap holes is set to approximate the angle of the shoe bindings on a standard snowboard and allows a user to assume a particular stance on the practice snowboard.

In alternative embodiments of the present invention, the number of strap holes per shoe, as well as the size and shape of the holes may differ from the configuration illustrated in FIG. 1A, to accommodate different types of straps or shoe binding systems. Likewise, the orientation angles of the strap holes relative to the longitudinal axis of the footboard may be varied in alternative embodiments of the present invention to accommodate different stances on the footboard 100.

Figure 1B:
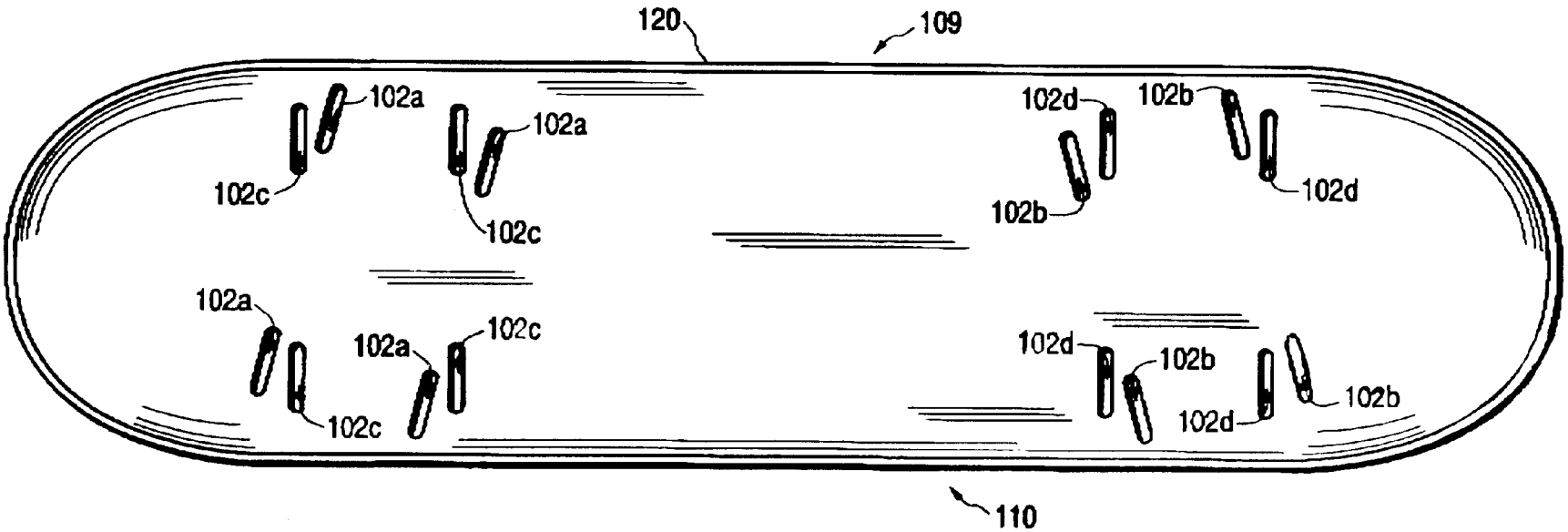
FIG. 1B illustrates a top view of a practice snowboard for use with a snowboard practice system, according to an alternative embodiment of the present invention.

In one embodiment of the present invention, more than one set of strap holes is provided for each shoe. FIG. 1B illustrates a practice snowboard that includes two sets of strap holes for each shoe. For footboard 120, edge 109 corresponds to the heel side and edge 110 corresponds to the toe side. Two sets of holes, comprising holes 102*a* and 102*c*, respectively, are provided for the user's right foot. Likewise, two sets of holes, comprising holes 102*b* and 102*d*, respectively, are provided for the user's left foot. In FIG. 1B, the set of four holes denoted 102*a* corresponds to hole set 104 in FIG. 1A, arid the set of four holes denoted 102*b* corresponds to hole set 106 in FIG. 1A. Only one set of strap holes per shoe is used at one time, and to ensure compatibility between the different hole sets, the size and shape of all of the holes are generally cut the same for each set of strap holes.

For the embodiment illustrated in FIG. 1B, strap hole set 102*c* for the right foot and strap hole set 102*d* for the left foot are oriented substantially perpendicular to the edges 109 and 110 of footboard 120. The second strap hole set for each foot is oriented at an angle relative these perpendicular strap hole sets. It will be appreciated by those of skill in the art, that in alternate embodiments of the present invention, the sets of strap holes for each foot may be oriented at different angles than those shown in FIG. 1B, depending on the different foot angles desired by the user.

For the embodiment illustrated in FIG. 1B, straps can be threaded through either of the two sets of strap holes provided for each shoe. Using different combinations of strap hole sets allows a user to change the stance he assumes on the footboard. Thus, for the four sets of strap holes illustrated in FIG. 1B, four different stance positions are possible. If strap holes 102*c* and 102*d* are used, the user assumes a straight stance in which his feet are parallel to one another. If strap holes 102*a* and 102*b* are used, the user assumes a "duck foot" stance in which his feet are pointed outward. If strap holes 102*c* and 102*b* are used, the user assumes a normal snowboard stance in which the leading (left) foot is pointed outward. If strap holes 102*a* and 102*d* are used, the user assumes an abnormal or "goofy" snowboard stance in which the back (right) foot is pointed outward.

Although FIG. 1B illustrates a specific orientation of the different sets of strap holes relative to one another, it should be noted that the sets of strap holes for each foot can be configured and oriented in various different ways in accordance with alternative embodiments of the present invention.

In one embodiment of the present invention, the footboard illustrated in FIG. 1A is fabricated from plywood, or a similar wood material. In an alternative embodiment of the present invention, the footboard is fabricated from fiberglass. In further alternative embodiments of the present invention, other materials could be used to fabricate the footboard, including plastic, carbon fiber, aluminum, and other similar materials, or composites of such materials.

Figure 2:
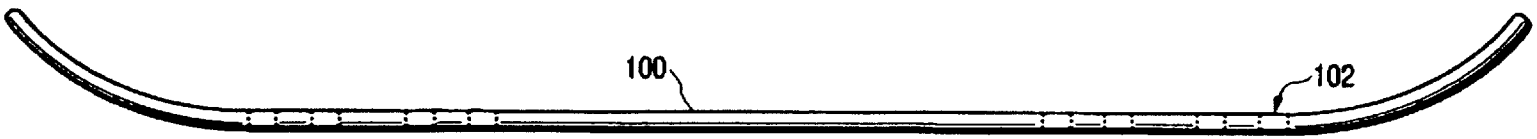
FIG. 2 illustrates a side view of the practice snowboard of FIG. 1A, according to one embodiment of the present invention.

In one embodiment of the present invention, the front and rear ends of the snowboard are turned up, similar to the ends of a standard snowboard. FIG. 2 is a side-view illustration of the footboard of FIG. 1A, illustrating the up-turned ends according to one embodiment of the present invention This allows a user to easily grab an end of the footboard during aerial maneuvers, and also reduces that chance that an end of the footboard will catch against an object or surface during aerial maneuvers.

In an alternative embodiment of the present invention, snowboard 100 in FIG. 1A is flat and does not feature turned up ends. Although this embodiment does not fully simulate the shape of a standard snowboard, it is generally easier to manufacture the footboard as a flat board rather than a curved board.

Figure 3:
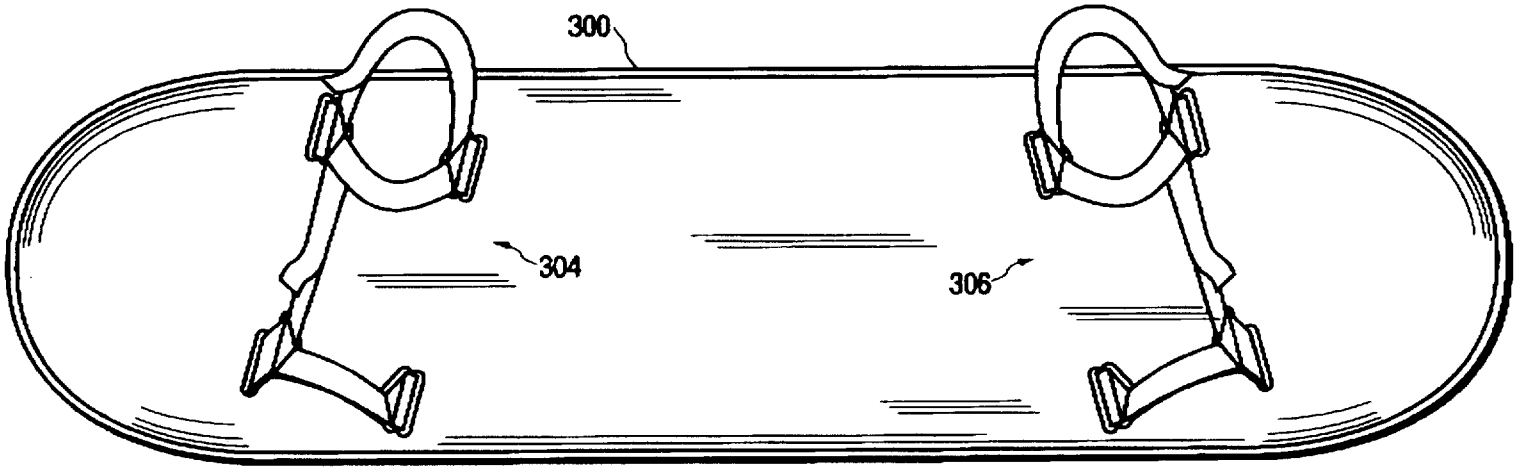
FIG. 3 illustrates the insertion of flexible straps in the practice snowboard of FIG. 1A, according to one embodiment of the present invention.

FIG. 3 illustrates the footboard of FIG. 1A with shoe binding straps installed, according to one embodiment of the present invention. The configuration of the shoe binding straps is designed to secure the front and rear portions of the user's shoes to the top surface of the footboard 300. One set of straps is provided for each shoe. Strap set 304 secures the user's right foot, and strap set 306 secures the user's left foot. In one embodiment of the present invention, the straps for each strap set are flexible flat fabric straps approximately one inch to two and a half inches wide. A suitable material that exhibits sufficient strength and flexibility is selected for the straps. Such materials include nylon, leather, or canvas. In alternative embodiments of the present invention, other similar materials may be used for the straps.

Figure 4:
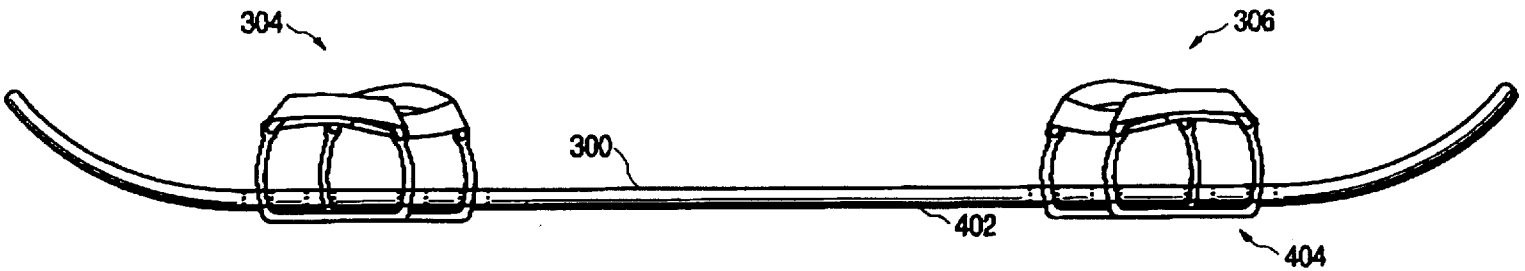
FIG. 4 is a side view of the practice snowboard of FIG. 3 with flexible straps installed, according to one embodiment of the present invention.

In one embodiment of the present invention, nylon straps approximately one inch to two and a half inches wide are looped through the strap holes cut into footboard 300. FIG. 4 illustrates a side view of the footboard with shoe binding straps installed, according to one embodiment of the present invention. For the embodiment illustrated in FIG. 4, the straps lie tight against the bottom surface 402 of footboard 300. Depending on the thickness of the straps employed, the bottom portions of the straps 404 will generally protrude slightly from the bottom surface of the footboard 300.

In an alternative embodiment of the present invention, grooves are cut into the bottom surface of the footboard. The grooves are cut to a width and height that match the width and thickness of the straps, such that the grooves act as countersinks for the straps and allow the straps to lie flush against the bottom surface of the footboard. The use of grooves to seat the straps in the bottom surface of the footboard reduces the risk that the bottom of the straps will catch or snag on other objects or surfaces when the board is being used. It also reduces wear and tear on the bottom of the straps since they will not be fully exposed to contact with other surfaces when seated within the bottom surface of the footboard. The grooves are cut into the bottom surface of the footboard in a pattern that corresponds to the configuration in which the straps are looped across the bottom surface of the footboard.

Figure 5:
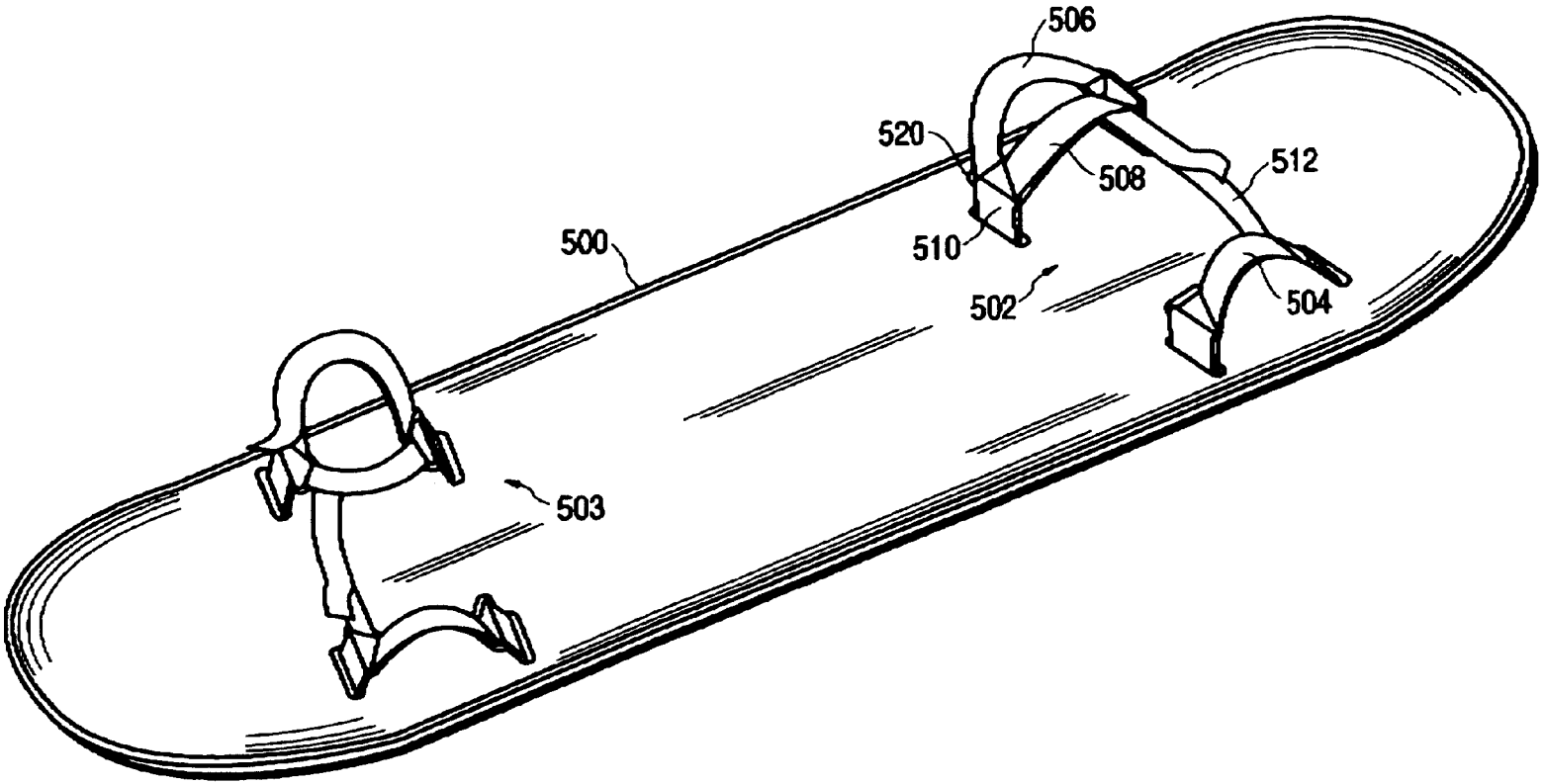
FIG. 5 is a top perspective view of the practice snowboard of FIG. 4 illustrating the configuration of the straps, according to one embodiment of the present invention.

FIG. 5 illustrates a top perspective view of the footboard of FIG. 3. The configuration of each of the strap sets 304 and 306 in FIG. 3 is discussed with reference to strap set 502 in FIG. 5. In one embodiment of the present invention, each strap set comprises a front strap loop 504 that loops over the front portion of the shoe, and a rear strap loop, consisting of straps 506 and 508, that loops around the back portion of the shoe. The rear strap loop is attached to the footboard 500 by strap 510. Both strap 504 and strap 510 loop underneath the footboard 500. The front and rear strap loops are connected to one another by strap 512. Strap links 520, such as a triangular link attach the straps to their corresponding loops. In accordance with embodiments of the present invention, the strap links 520 may be made of metal or hard plastic, and may be formed in a variety of different shapes, such as triangular, square, or oval, sufficient to accommodate the number of straps being joined. For the embodiment of the present invention illustrated in FIG. 5, the configuration of the right foot strap set 503 is the same as that for the left foot strap set 502.

In one embodiment of the present invention, the front strap loop includes an attachment that closes and opens the front loop. Likewise, the rear strap loop includes an attachment that closes and opens the rear loop. For each shoe, the user opens both strap loops, steps onto the footboard, wraps the strap loops around his shoe, and secures his shoe onto the footboard with the attachments. In one embodiment of the present invention, in which the straps are fabricated in a flexible material, such as nylon or canvas, the attachments are implemented as VELCRO™ closures consisting of a piece fabric of small hooks that sticks to a corresponding fabric of small loops. In an alternative embodiment of the present invention, the attachments are implemented as metal or hard plastic buckles. The actual type of buckle used is selected to provide the optimum buckling method for the type of material used for the straps, e.g., nylon, leather, rope, and so on.

In a further alternative embodiment of the present invention, strong elastic strap material is used for each of the strap sets. For this embodiment, the elasticity of the straps is sufficient to secure a user's feet to the footboard, and it is not necessary to provide means for opening and closing the front and rear strap loops.

Although a specific configuration of the straps was illustrated for the embodiment of FIG. 5, it will be appreciated by those of ordinary skill in the art, that various other strap configurations are possible. For example, a single strap can be threaded through the strap holes and looped in an appropriate manner around the user's shoes and secured with a single attachment.

Figure 6:
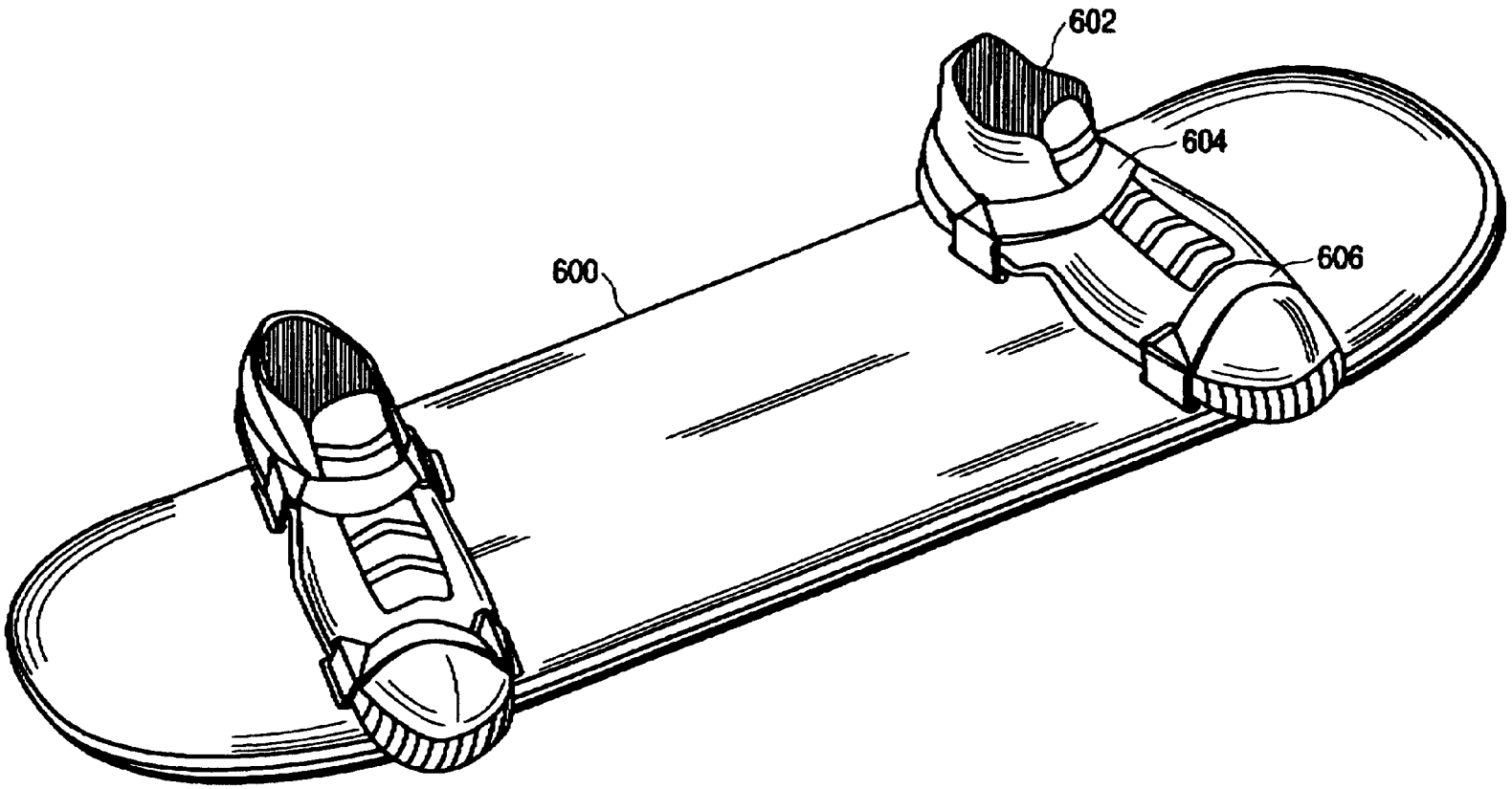
FIG. 6 illustrates the practice snowboard of FIG. 5 with a pair of shoes secured to the footboard by the flexible straps, according to one embodiment of the present invention.

FIG. 6 illustrates the footboard of FIG. 5 with a pair of shoes strapped to the board. As can be seen in FIG. 6, each shoe, such as shoe 602 is securely attached to footboard 600 by a front strap loop 606 and a rear strap loop 604. In accordance with embodiments of the present invention, a variety of different types of shoes can be used with the footboard illustrated in FIG. 5. Typical examples include, athletic shoes, high top sneakers, boots, or snowboard boots.

Figure 7:
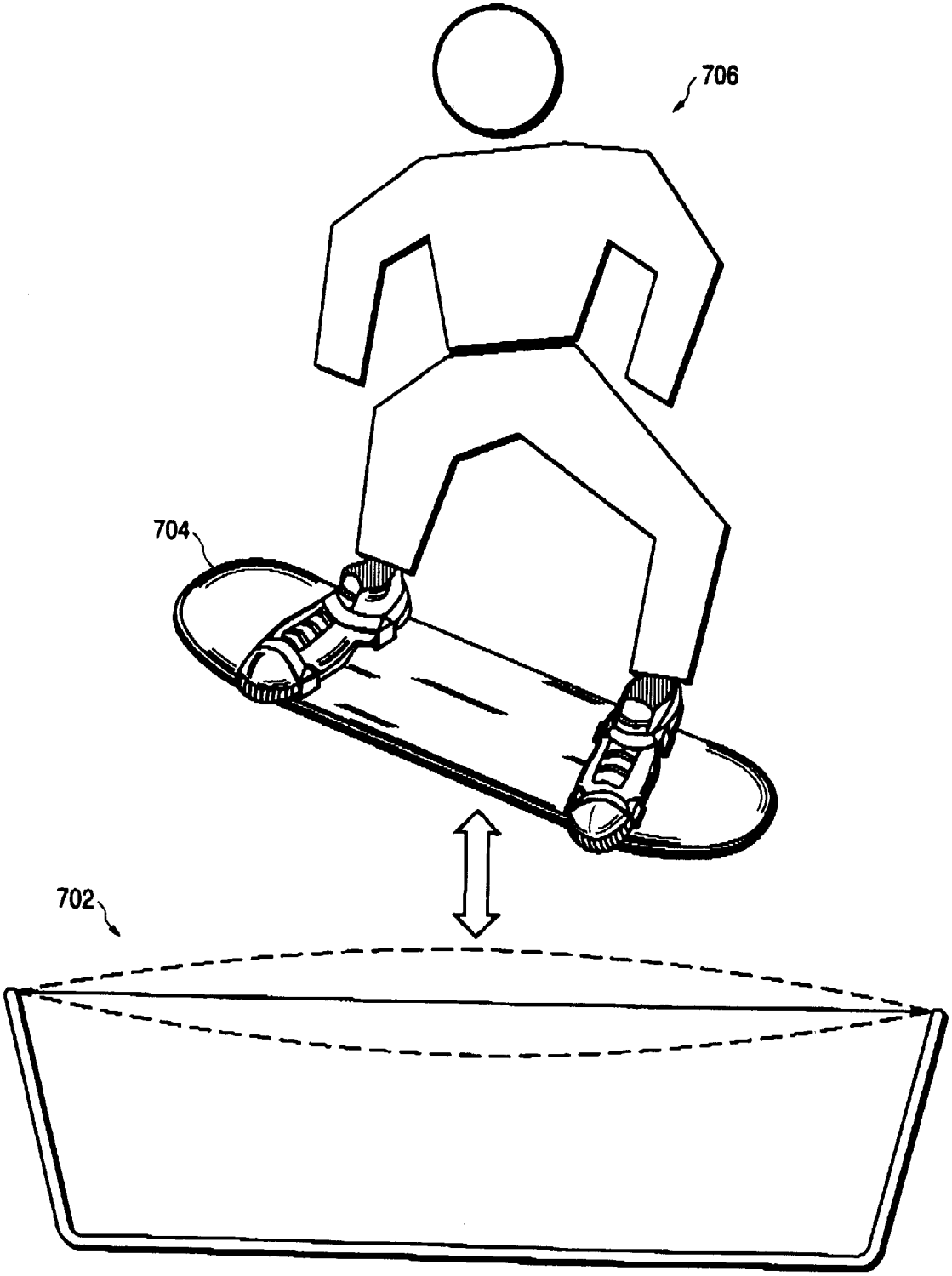
FIG. 7 illustrates the use of a practice snowboard on a trampoline, according to one embodiment of the present invention.

In one embodiment of the present invention, the footboard is used in conjunction with a trampoline to recreate jumps and aerial tricks that can be performed while snowboarding. A user straps on the practice snowboard and proceeds to jump up and down on the surface of a trampoline. While jumping up and down, the user can practice various flips, twirls, and other aerial snowboarding tricks and maneuvers. FIG. 7 illustrates the use of a practice snowboard in conjunction with a trampoline, according to one embodiment of the present invention. As shown in FIG. 7, user 706 on practice snowboard 704 jumps up and down on trampoline 702. While in the air the user can perform various aerial or acrobatic maneuvers, such as flips and twirls.

In one embodiment of the present invention, the trampoline 702 illustrated in FIG. 7 is a standard trampoline consisting of a resilient fabric sheet supported by springs and attached to a metal frame. In alternative embodiments of the present invention, the practice snowboard 704 can be used with other types of bouncing devices, such as springboards, and the like.

Figure 8:
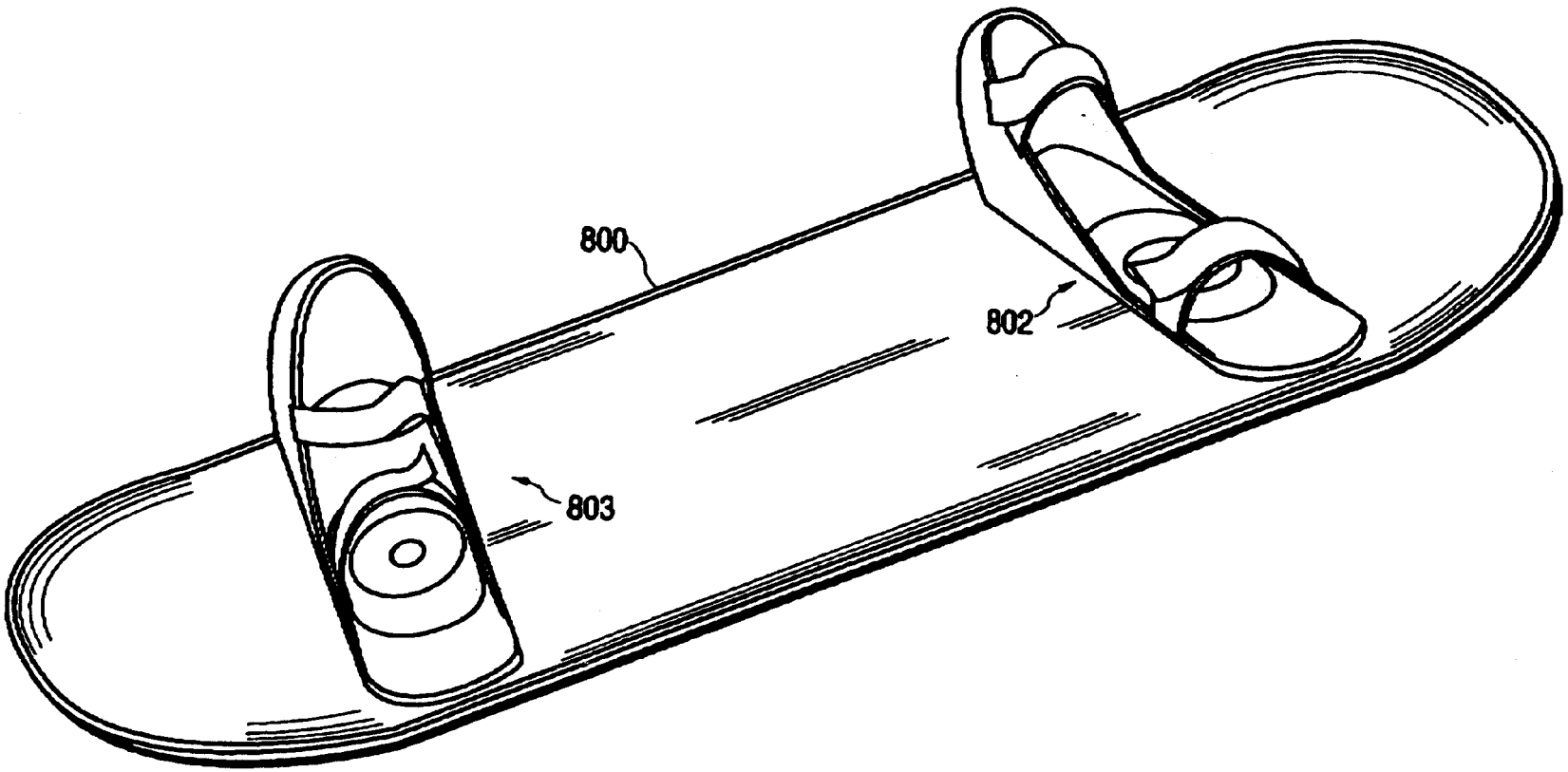
FIG. 8 is a top perspective view of a practice snowboard that includes standard snowboard bindings, according to an alternative embodiment of the present invention.

In one embodiment of the present invention, thc practice snowboard used in conjunction with the trampoline in FIG. 7 comprises a footboard with standard snowboard bindings attached FIG. 8 illustrates a practice snowboard in which footboard 800 includes a snowboard binding 803 to secure the user's right foot, and snowboard binding 802 to secure the user's left foot. For this embodiment, snowboard 800 does not include strap holes as illustrated in FIG. 1A, but instead includes binding points that are suitable for the mounting of the snowboard bindings 802 and 803.

For the embodiment illustrated in FIG. 8, bindings 802 and 803 represent standard snowboard binding system for soft boots comprising two straps and a heel cup mounted on a base plate. In further alternative embodiments of the present invention, different types of snowboard bindings may be used, such as baseless bindings, hard boot bindings, step-in soft bindings, and other such snowboard binding systems.

Although embodiments of footboard of the present invention were previously described and illustrated as being formed in the shape and size of a standard snowboard, it should be noted that the footboard can also be cut into the shape and size of other board types. For example, the footboard can be cut and shaped to a size that approximates a skateboard. When used in conjunction with the binding system and trampoline described above, the resulting practice skateboard can be used to practice aerial skateboard tricks.

In the foregoing, an apparatus has been described for practicing aerial snowboard maneuvers. Although the present invention has been described with reference to specific exemplary embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

What is claimed is:

1. An apparatus for performing aerial snowboard maneuvers comprising:

a footboard, the footboard including a first set of holes and a second set of holes;

a first set of straps looped through the first set of holes;

a second set of straps looped through the second set of holes; and a resilient surface configured to be jumped on by a user wearing the footboard, and operable to cause the user to become airborne when the user jumps up and down on the resilient surface while wearing the footboard.

2. The apparatus of claim 1 wherein each of the first set of straps and the second set of straps comprises a first strap loop operable to secure a front portion of a shoe to the top surface of the footboard, and a second strap loop operable to secure a rear portion of the shoe to the top surface of the footboard.

3. The apparatus of claim 2 wherein at least one end of the footboard is turned upward to simulate the side profile of a conventional snowboard.

4. The apparatus of claim 3 wherein the straps comprising the first and second set of straps are composed of a flat flexible fabric material, and wherein holes comprising the first and second set of holes are formed in approximately oblong shapes to accommodate the threading of the straps therethrough.

5. The apparatus of claim 4 wherein each of the first set of holes and the second set of holes comprises four holes arranged in two rows of two holes each.

6. The apparatus of claim 5 wherein the first set of holes and the second set of holes each comprise two parallel sets of holes and wherein an axis defining an orientation of the parallel sets of holes for at least one of the first set of holes and the second set of holes is oriented at an angle relative to a longitudinal axis of the footboard.

7. The apparatus of claim 2 wherein each of the first set of straps and the second set of straps further comprises:

a first attachment coupled to the first strap loop and configured to open and close the first strap loop to allow a user to secure or release the front portion of a shoe to or from the footboard; and a second attachment coupled to the second strap loop and configured to open and close the second strap loop to allow the user to secure or release the rear portion of the shoe to or from the footboard.

8. The apparatus of claim 7 wherein each of the first set of straps and the second set of straps further comprises a strap coupling the first strap loop to the second strap loop.

9. The apparatus of claim 2 wherein the footboard is made of wood.

10. The apparatus of claim 2 wherein the footboard is cut to a size and shape that approximates the size and shape of a conventional skateboard.

11. The apparatus of claim 6 wherein the ends of a bottom surface of the footboard comprises a plurality of grooves configured to allow a portion of the straps threaded along the bottom surface of the footboard to seat flush against the bottom surface of the footboard.

12. The apparatus of claim 2 wherein the resilient surface comprises a trampoline.

13. The apparatus of claim 2 wherein the resilient surface comprises a springboard.

14. An apparatus for performing aerial snowboard maneuvers comprising:

board means for supporting a user;

strap means for securing the user's feet to a top surface of the board means; and bouncing means for allowing a user to jump up and down in a controlled manner while wearing the board means and thereby simulate conditions achieved while performing jumps on snow using a snowboard.

15. The apparatus of claim 14 wherein the board means comprise a board formed in a substantially elongated oval shape, and further comprising a first set of holes and a second set of holes cut therethrough and configured to allow a user secured to the board to assume a stance substantially similar to a stance assumed when using a conventional snowboard.

16. The apparatus of claim 15 wherein the strap means comprise a first set of straps looped through the first set of holes and a second set of straps looped through the second set of holes, the first set of straps and the second set of straps operable to secure the user's feet to the board.

17. The apparatus of claim 16 wherein the strap means further comprise attachment means for opening or closing the strap means to allow a user to secure or release a shoe to or from the board.

18. An apparatus for performing aerial snowboard maneuvers comprising:

a footboard;

a first plurality of holes located proximate to a first end of the footboard, the first plurality of holes including a first set of strap holes and a second set of strap holes;

a second plurality of holes located proximate to a second end of the footboard, the second plurality of holes including a third set of strap holes and a fourth set of strap holes; and a resilient surface configured to be jumped on by a user wearing the footboard, and operable to cause the user to become airborne when the user jumps up and down on the resilient surface while wearing the footboard, wherein the first plurality of holes are arranged to accommodate a first set of straps looped through either the first set of strap holes or the second set of strap holes, and the second plurality of holes are arranged to accommodate a second set of straps looped through either the third set of strap holes or the fourth set of strap holes.

19. An apparatus for performing aerial snowboard maneuvers comprising:

a footboard;

a first plurality of holes located proximate to a first end of the footboard, the first plurality of holes including a first set of strap holes and a second set of strap holes; and a second plurality of holes located proximate to a second end of the footboard, the second plurality of holes including a third set of strap holes and a fourth set of strap holes, wherein the first plurality of holes are arranged to accommodate a first set of straps looped through either the first set of strap holes or the second set of strap holes, the second plurality of holes are arranged to accommodate a second set of straps looped through either the third set of strap holes or the fourth set of strap holes, each of the first set of straps and the second set of straps comprises a first strap loop operable to secure a front portion of a shoe to the top surface of the footboard, and a second strap loop operable to secure a rear portion of the shoe to the top surface of the footboard, the straps comprising the first and second set of straps are composed of a flat flexible fabric material, and wherein each of the holes comprising the first plurality of holes and the second plurality of holes are formed in approximately oblong shapes to accommodate the threading of the straps therethrough, and resilient surface configured to be jumped on by a user wearing the footboard, and operable to cause the user to become airborne when the user jumps up and down on the resilient surface while wearing the footboard.

20. The apparatus of claim 19 wherein the arrangement of the first and second set of strap holes relative to the third and fourth set of strap holes allows a user to change a stance on the footboard in accordance with which set of strap holes the straps are threaded through.

21. An apparatus for performing aerial snowboard maneuvers comprising:

a footboard;

a first snowboard boot binding coupled to a top surface of the footboard;

a second snowboard boot binding coupled to the top surface of the footboard; and a resilient surface configured to be jumped on by a user wearing the footboard, and operable to cause the user to become airborne when the user jumps up and down on the resilient surface while wearing the footboard.

22. The apparatus of claim 21 wherein the resilient surface comprises a trampoline.

* * * * *